US006764234B2

(12) United States Patent
Ono et al.

(10) Patent No.: US 6,764,234 B2
(45) Date of Patent: Jul. 20, 2004

(54) TORQUE CLUTCH APPARATUS AND PRINTER APPARATUS

(75) Inventors: Katsuhisa Ono, Tokyo (JP); Yoshinori Yamane, Tokyo (JP)

(73) Assignee: Sony Corporation, Tokyo (JP)

( * ) Notice: Subject to any disclaimer, the term of this patent is extended or adjusted under 35 U.S.C. 154(b) by 131 days.

(21) Appl. No.: 10/073,498

(22) Filed: Feb. 11, 2002

(65) Prior Publication Data

US 2002/0141804 A1 Oct. 3, 2002

(30) Foreign Application Priority Data

Feb. 10, 2001 (JP) ..... P2001-077218

(51) Int. Cl.[7] ..... B41J 33/22
(52) U.S. Cl. ..... 400/236.2; 400/120.01
(58) Field of Search ..... 400/120.01, 12.02, 400/236.2, 236, 230, 225, 223, 222, 221, 234

(56) References Cited

U.S. PATENT DOCUMENTS 3,966,036 A * 6/1976 Bernardis et al. ..... 400/219.1
4,025,830 A * 5/1977 Delaporte ..... 318/6
5,529,410 A * 6/1996 Hunter et al. ..... 400/234
5,769,547 A * 6/1998 Igarashi ..... 400/120.01
5,820,280 A * 10/1998 Fox ..... 400/611
6,019,529 A * 2/2000 Yamamoto et al. ..... 400/231
6,034,708 A * 3/2000 Adams et al. ..... 347/217
6,315,471 B1 * 11/2001 Hsieh et al. ..... 400/234

* cited by examiner

*Primary Examiner*—Anthony H. Nguyen
(74) *Attorney, Agent, or Firm*—Sonnenschein, Nath & Rosenthal LLP

(57) ABSTRACT

A simple and lightweight torque clutch apparatus capable of freely changing a torque and a printer apparatus capable of tension controlling of ink ribbon in a simplified structure are proposed. A torque clutch apparatus includes a shaft, a first gear rotatably fitted to the shaft, first and second sandwiching members fitted to the shaft so as to sandwich the first gear therebetween and to rotate integrally with the shaft, a second gear rotatably screwed on the shaft, and a spring arranged between the second gear and the first or second sandwiching member opposing the second gear. A printer apparatus includes first torque-generating means for generating a variable load torque to a feed reel of ink ribbon, second torque-generating means for generating a variable rotational torque to a winding reel, and controlling means for controlling the first and/or second torque-generating means so as to generate the load torque or rotational torque corresponding to the diameter of the roll of ink ribbon wound on the feed reel and/or winding reel.

4 Claims, 16 Drawing Sheets

TORQUE CLUTCH APPARATUS AND PRINTER APPARATUS

RELATED APPLICATION DATA

The present application claims priority to Japanese Application(s) No(s). P2001-077218 filed Feb. 10, 2001, which application(s) is/are incorporated herein by reference to the extent permitted by law.

BACKGROUND OF THE INVENTION

1. Field of the Invention

The present invention relates to a torque clutch apparatus and printer apparatus which are suitable when being applied to a color roll printer, for example.

2. Description of the Related Art

In a printer apparatus using ink ribbon, when ink ribbon slackens during printing, it may wrinkles so as to deteriorate printed images.

Therefore, in such a conventional printer apparatus, by controlling a winding reel and/or feed reel of ink ribbon with torque clutches such as felt clutches, a constant tension is applied to the ink ribbon.

However, according to such a method, since the diameter of the roll of ink ribbon wound on the feed reel and the diameter of the roll of ink ribbon wound on the winding reel gradually change due to printing, there is a problem that a constant tension cannot be always applied to the ink ribbon.

As for techniques for solving such a problem, there may be a first method of controlling the output of a motor and a second method of using a torque clutch with a variable output-torque such as a powder clutch and a hysteresis clutch. According to the first method, there has been a problem that the travelling stability of ink ribbon is damaged due to non-uniform feed motion of a gear or belt. According to the second method, there have also been problems that cost is increased and the entire printer apparatus becomes large in size and weight, because the powder clutch and hysteresis clutch are very expensive and large in size and weight.

SUMMARY OF THE INVENTION

In view of the problems described above, the present invention has been made and it is an object of the present invention to propose a simple and lightweight torque clutch apparatus capable of freely changing a torque, and a printer apparatus capable of stably controlling tension of ink ribbon by a simple structure.

In order to solve these problems, according to the present invention, a torque clutch apparatus comprises a shaft which is rotatably pivotably mounted and which has a screw thread formed on the circumferential surface thereof, a first gear rotatably fitted to the shaft, first and second sandwiching members fitted to the shaft so as to sandwich the first gear therebetween and to rotate integrally with the shaft, a second gear rotatably screwed on the shaft, and a spring arranged between the second gear and one of the first and second sandwiching members opposing the second gear. Therefore, the torque clutch apparatus is simple in construction and the output torque can be freely changed by rotating the second gear.

Also, according to the present invention, a printer apparatus comprises first torque-generating means for generating a variable load torque applied to a feed reel, which is rotatably supported, of ink ribbon; second torque-generating means for variably generating a rotational torque to a winding reel, which is rotatably supported, of ink ribbon; and controlling means for controlling the first and/or second torque-generating means so as to generate one of the load torque and rotational torque in accordance with the diameter of the roll of ink ribbon wound on the feed reel and/or the winding reel. As a result, the printer apparatus can maintain the tension of ink ribbon constant at all times.

DESCRIPTION OF THE PREFERRED EMBODIMENTS

An embodiment according to the present invention will be described in detail below with reference to the drawings.

(1) The Entire Structure of a Color Roll Printer According to the Embodiment

Figure 1:
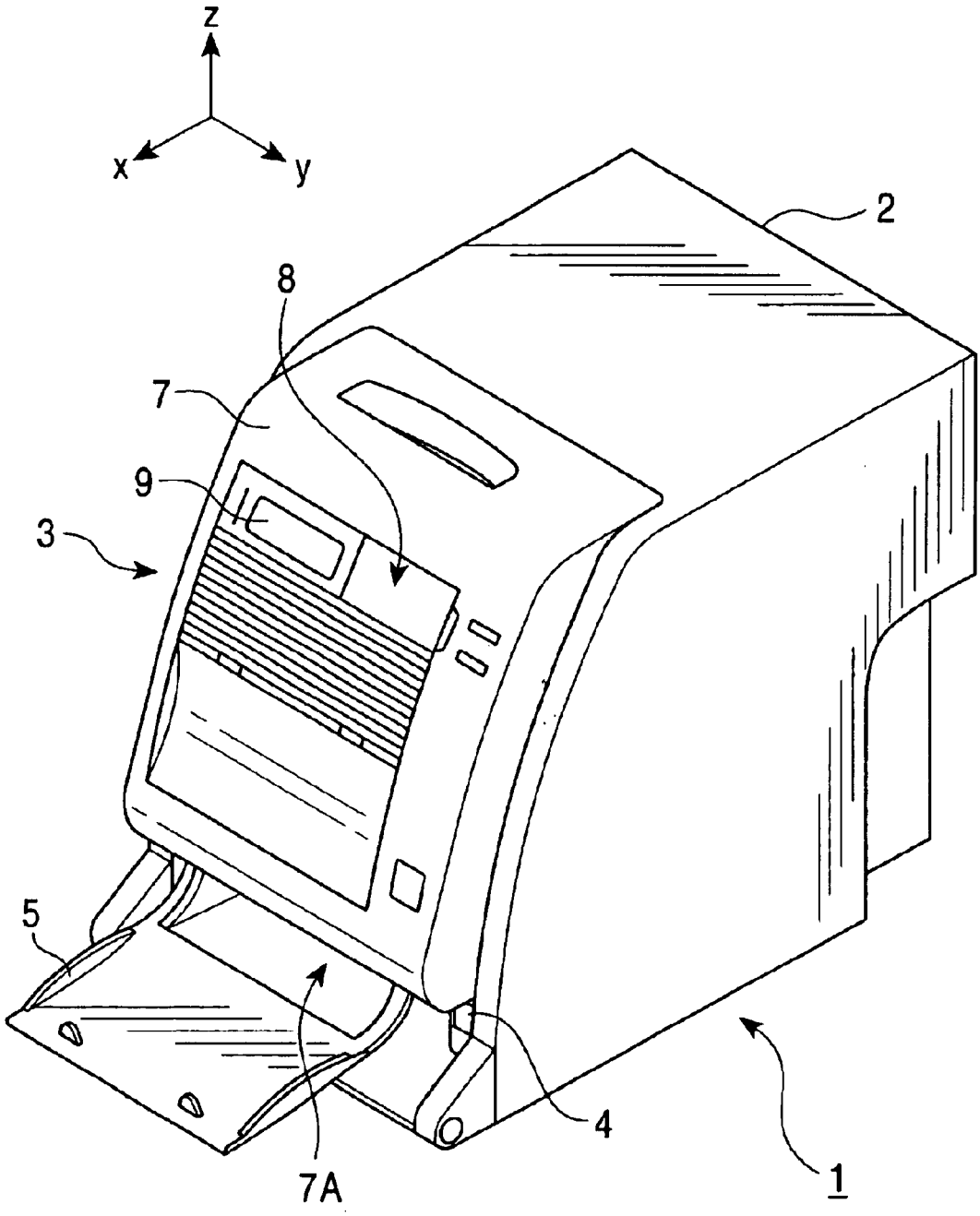
FIG. 1 is a perspective view of the structure of a color roll printer according to an embodiment.
Figure 2:
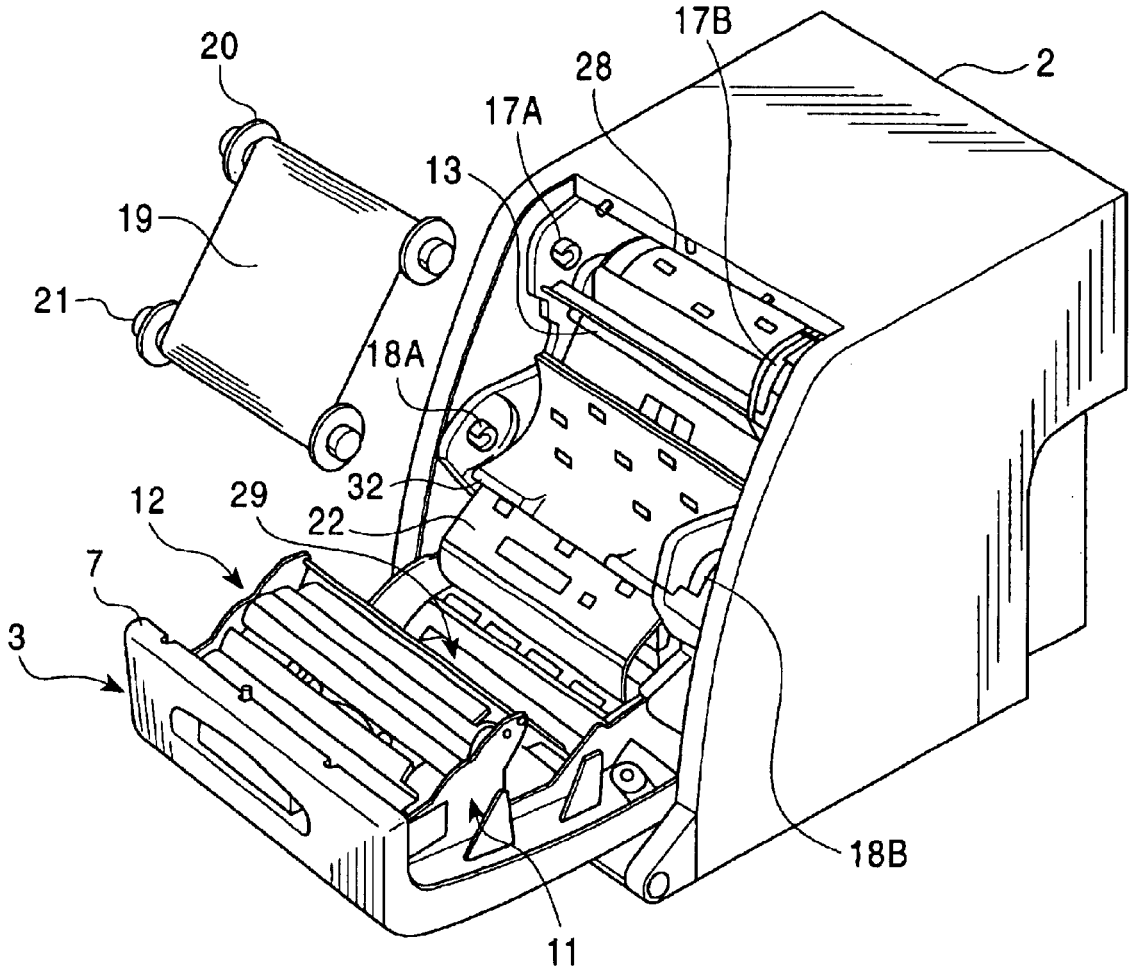
FIG. 2 is a perspective view of the structure of the color roll printer according to the embodiment.

Referring to FIGS. 1 and 2, a color roll printer 1 according to the present invention as a whole comprises a case 2; a door 3, a power switch 4, and a sheet-discharge tray 5, these which are arranged on the front face of the case 2; and a connector connection (not shown) comprising plural connectors for external connections arranged on the rear face of the case 2.

The door 3 is constructed of a door chassis 6 arranged rotatably about the lower end of the case 3 and a door panel 7 attached on the front face of the door chassis 6. The door panel 7 is respectively provided with an operating panel 8 having various kinds of switches and a liquid crystal panel 9 for displaying various kinds of messages on the front face of the door panel 7, and has a sheet-discharge opening 7A formed at the lower end of the door panel 7.

Therefore, in the color roll printer 1, operations of the various switches, confirmations of the various messages, and taking out of printed outputs can be performed on the front face of the printer.

On the front face of the door chassis 6 covered with the door panel 7, a cutter mechanism 10 for cutting a roll sheet is arranged by corresponding to the sheet-discharge opening 7A on the door panel 7. Inside the door chassis 6, a line-type thermal head 12 held by a head-supporting mechanism 11 is arranged.

On the other hand, in the front inside of the case 2 shrouded with the door 3, a platen 13 is rotatably arranged in parallel to the arrow y direction by corresponding to the thermal head 12, while in the vicinity of the platen 13, a grip roller 15 and pinch roller 16 for driving and running a roll sheet 14 are arranged.

Also, in the front inside of the case 2, a first winding-reel retainer 17A and a first feed-reel retainer 18A are rotatably arranged at an upper step position and middle step position on the left internal face, respectively, while a second winding-reel retainer 17B and a second feed-reel retainer 18B are respectively arranged at an upper step position and middle step position on the right internal face by corresponding to these retainers 17A and 18A.

Therefore, in the color roll printer 1, a winding reel 20 and a feed reel 21 for ink ribbon 19 are respectively and rotatably supported with the first and second winding-reel retainers 17A and 17B and the first and second feed-reel retainers 18A and 18B in parallel with the platen 13 by sandwiching the platen 13 between them in the height direction.

Figure 3:
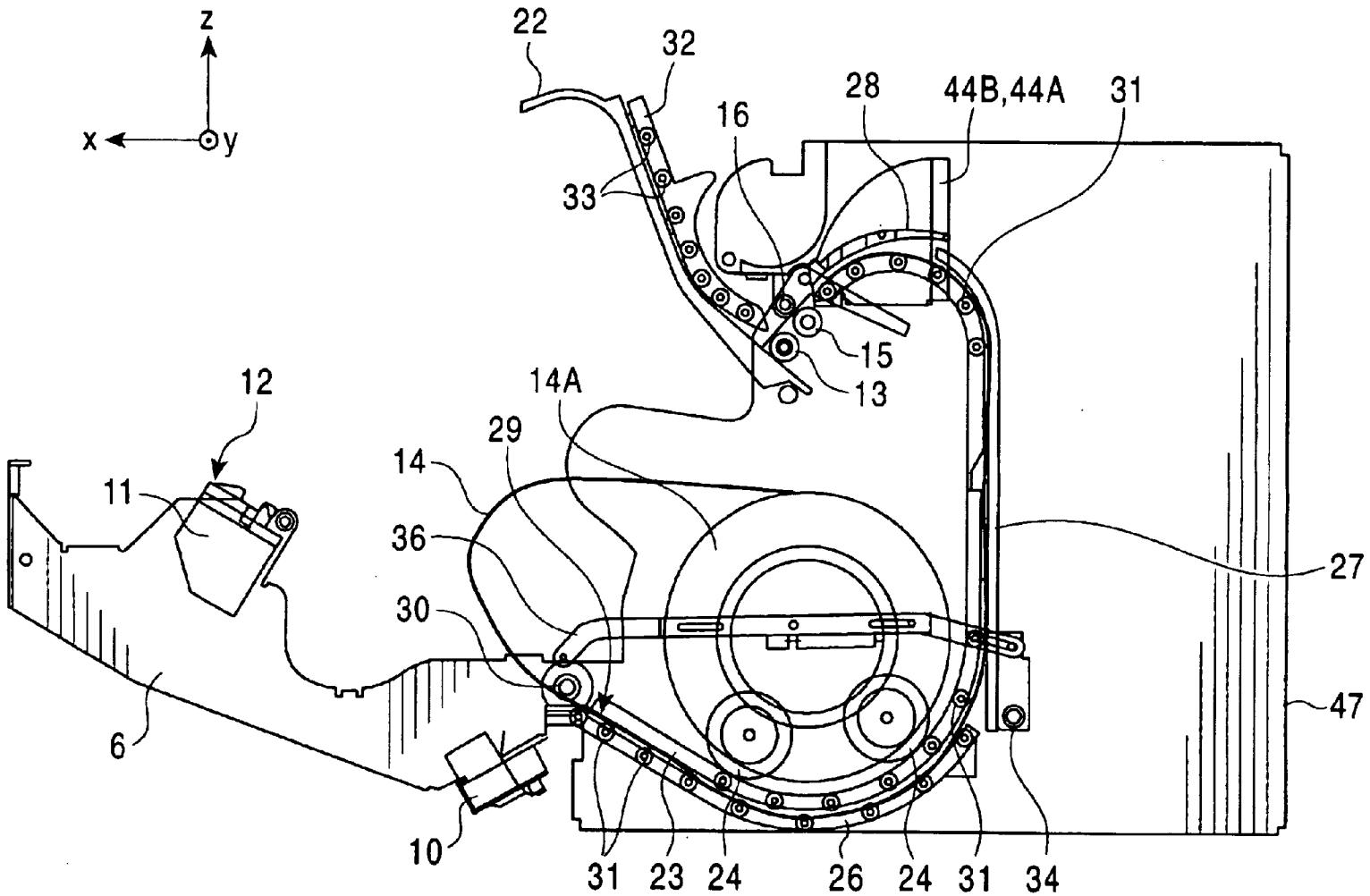
FIG. 3 is a schematic representation for showing a running path of a roll sheet.

Furthermore, at the lower position of the platen 13, an internal door 22 being rotatable about the upper end thereof is arranged, and a paper holder 23 is mounted in the inner part of the internal door 22 and has curved portions, each having a predetermined curvature, respectively arranged in the upper and lower parts, as shown in FIG. 3.

On both internal side-faces of the paper holder 23 in the vicinity of the bottom surface thereof, pairs of supporting rollers 24 are rotatably mounted, respectively, and as shown in FIG. 3, a roll of the roll sheet 14 (referred to as a sheet roll 14A below) is to be rotatably supported with these supporting rollers 24.

As is apparent from FIG. 3, a lower fixed guide 26, a movable guide 27, and an upper fixed guide 28 are respectively arranged in the external periphery of the paper holder 23 via clearances so as to cover a region ranging from the lower front end to the lower rear end of the paper holder 23, the rear of the paper holder 23, and a region from the upper rear to the upper front end of the paper holder 23, while a sheet-discharge guide 32 is arranged on the internal door 22 via a clearance so as to cover a region ranging from the vicinity of the upper end to the lower end vicinity of the internal door 22.

Therefore, in the color roll printer 1, a roll sheet 14 drawn from a sheet roll 14A is guided by the paper holder 23, the lower fixed guide 26, the movable guide 27, and the upper fixed guide 28, and passing through the rear part of the sheet roll 14A, toward an image printing position, which is sandwiched between the platen 13 and the thermal head 12 via the grip roller 15 and the pinch roller 16, while the roll sheet 14 fed from the image printing position is further guided to run toward the sheet-discharge opening 7A (FIG. 1) of the door panel 7 (FIG. 1) via the cutter mechanism 10.

Therefore, at the lower front end inside the paper holder 23, a guide roller 30 is rotatably mounted for guiding the roll sheet 14 drawn from the sheet roll 14A to the opening front end (referred to as a roll sheet insertion-hole 29 below) of the clearance between the paper holder 23 and the lower fixed guide 26. On the external peripheral face of the paper holder 23 and opposing faces to the paper holder 23 in the lower fixed guide 26 and the upper fixed guide 28, plural guide rollers 31 and 33, each having a rotational shaft parallel to the arrow y direction, are rotatably arranged, and on the opposing face of the sheet-discharge guide 32 to the internal door 22, plural guide rollers 33 having rotational shafts are also rotatably arranged, so that the roll sheet 14 is prevented beforehand by the guide rollers 30, 31 and 33 from generating an unwanted load in running the sheet or from damaging the printing surface of the roll sheet 14 due to the friction between the end of the roll sheet insertion-hole 29 or the external peripheral face of the paper holder 23 and the roll sheet 14.

Figure 4:
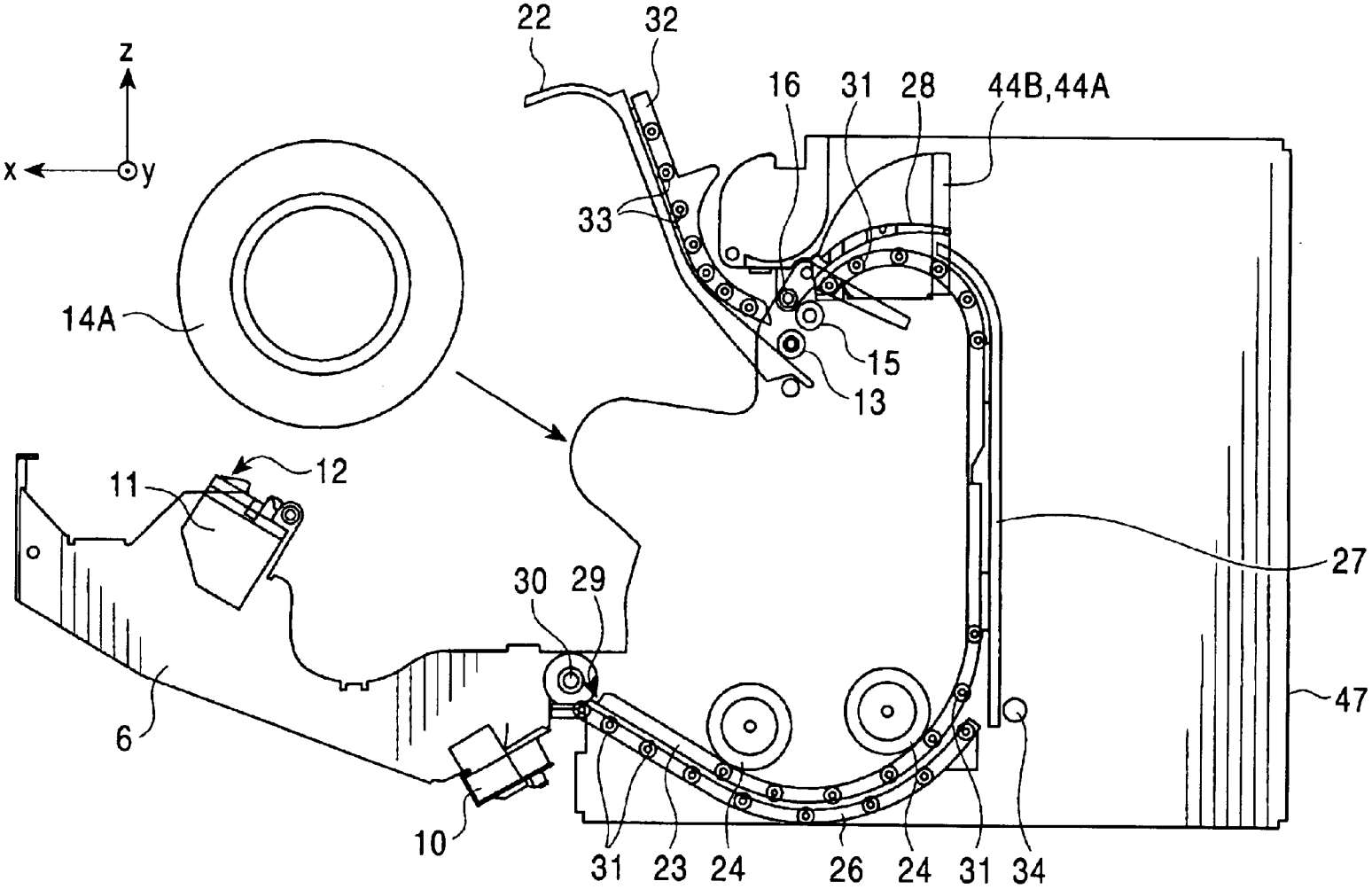
FIG. 4 is a schematic representation for showing a method of setting the roll sheet and ink ribbon.
Figure 5:
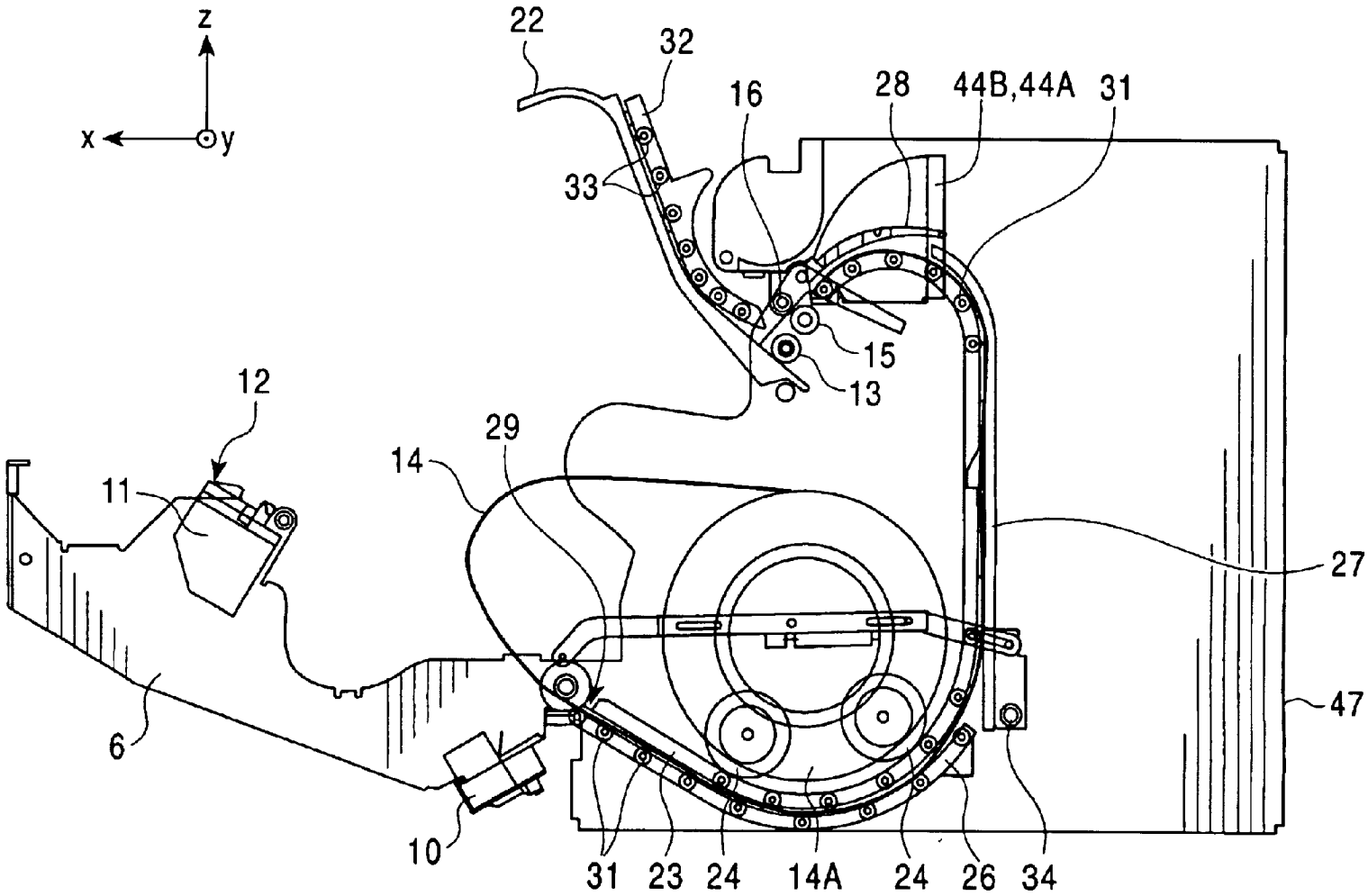
FIG. 5 is a schematic representation for showing the method of setting the roll sheet and ink ribbon.

Accordingly, in the color roll printer 1, as shown in FIG. 4, the door 3 is opened and then the internal door 22 is opened so as to place the sheet roll 14A within the paper holder 23 inside the case 2. Then, as shown in FIG. 5, the roll sheet 14 drawn from the sheet roll 14A can be set by pushing it into the roll sheet insertion-hole 29 until the tip end thereof abuts the internal door 22.

Figure 6:
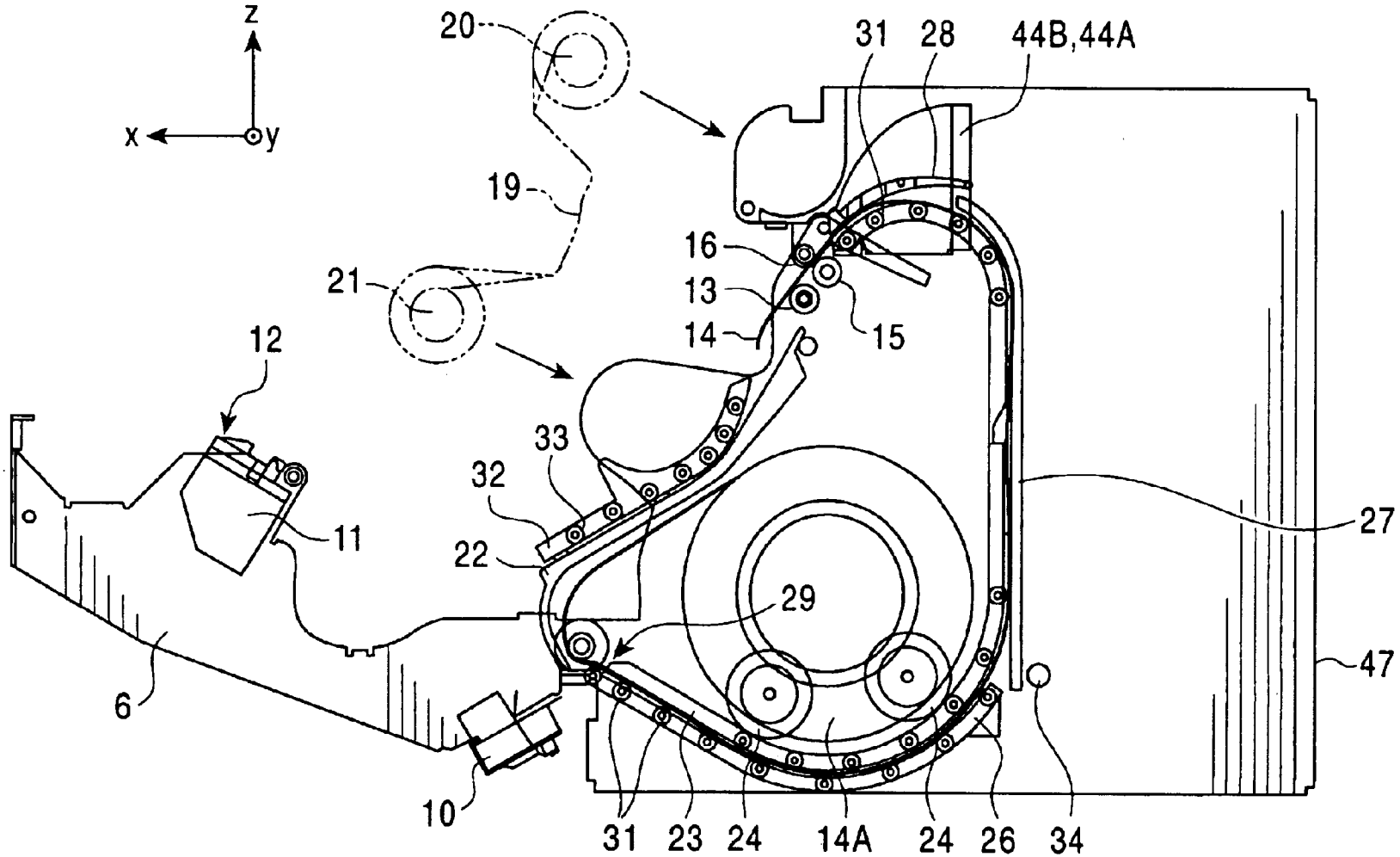
FIG. 6 is a schematic representation for showing the method of setting the roll sheet and ink ribbon.

Also, as shown in FIG. 6, the internal door 22 is then closed, so that the ink ribbon 19 can be set by respectively engaging the winding reel 20 and the feed reel 21 of the ink ribbon 19 with the first and second retainers 17A and 17B for the winding reel and the first and second retainers 18A and 18B for the feed reel in predetermined states. In such manners, in the color roll printer 1, the roll sheet 14 and the ink ribbon 19 can be loaded.

In addition, the color roll printer 1 is configured to print images while the roll sheet 14 is pulled back, as will be described later.

The movable guide 27 is therefore rotatable about a shaft 34 arranged at the lower end thereof in parallel to the arrow direction y in the color roll printer 1. Thus, when printing, the movable guide 27 is rotated about the shaft 34 in a direction separating from the paper holder 23 as shown in FIG. 8, for example, so as to form a space 35 (FIG. 8) between the paper holder 23 and the movable guide 27, enabling the roll sheet 14 to be pulled back during the printing to be slackened within the space 35.

Figure 8:
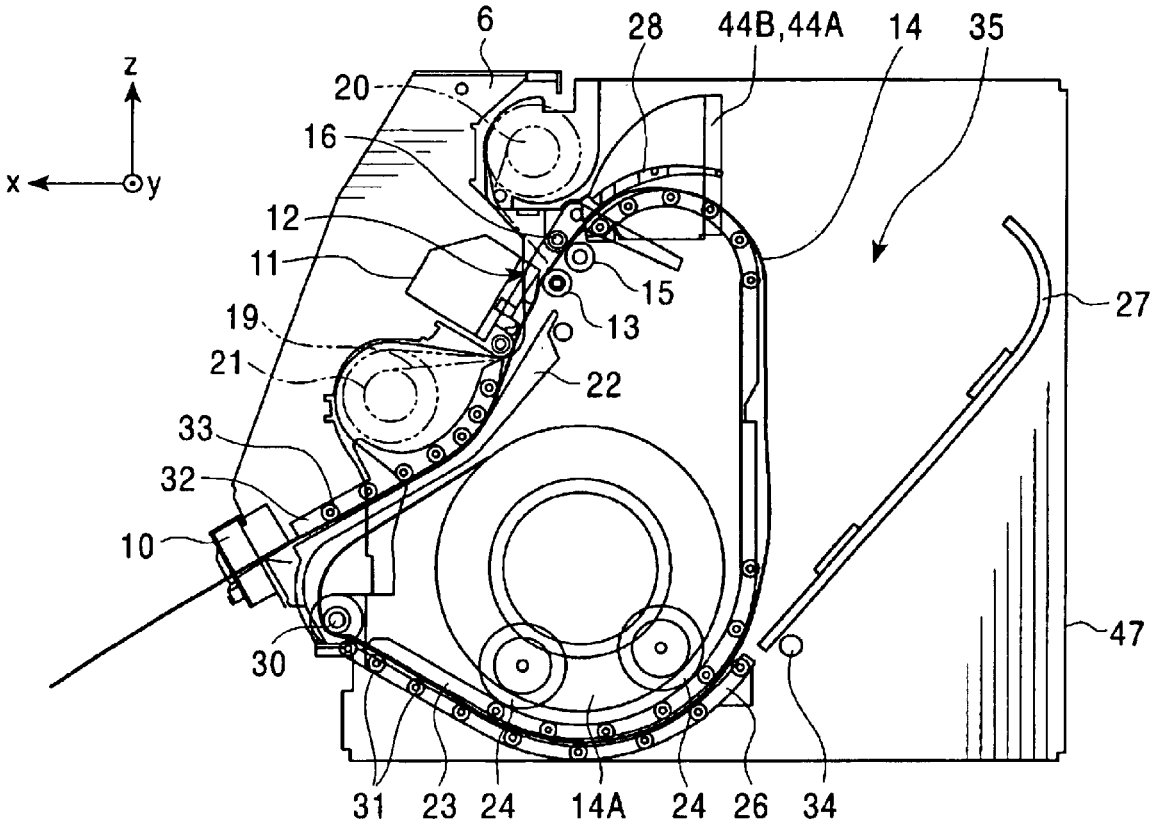
FIG. 8 is a schematic representation for showing an initial operation of the color roll printer.

The lower end part of the movable guide 27 and the lower end part of the door chassis 6 are connected via a link mechanism 36, so that the movable guide 27 can be returned from the falling-down state as shown in FIG. 8 (referred to as an open state below) to the state opposing the paper holder 23 via a clearance as shown in FIG. 3 (referred to as a closed state below) by linking with the opening operation of the door 3 (FIG. 1).

Thereby, when setting the roll sheet 14 in the color roll printer 1, the opposing surface of the movable guide 27 to the paper holder 23 can serve as a guide for the roll sheet 14 in the running direction.

Figure 7:
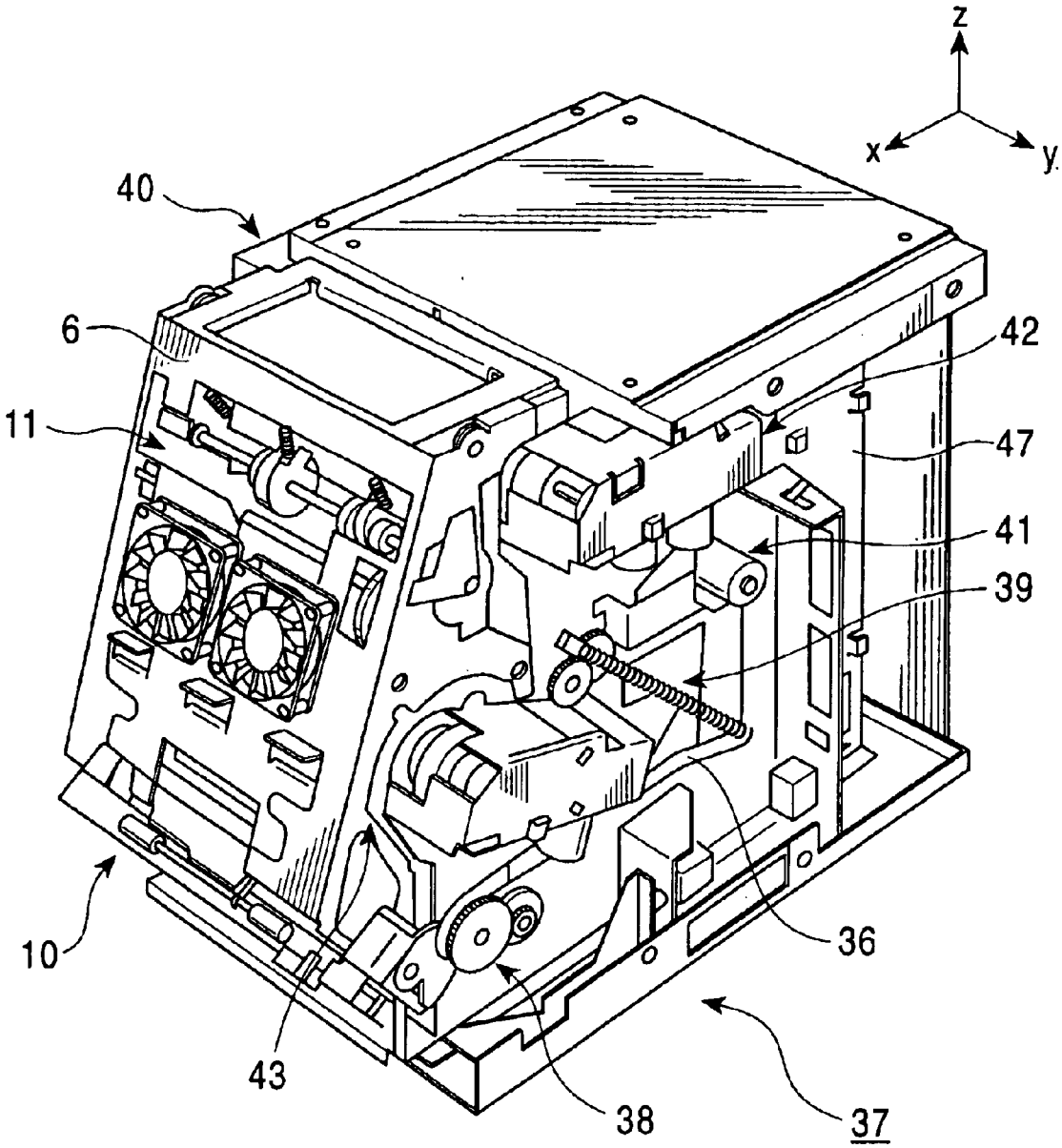
FIG. 7 is a perspective view of the internal structure of the color roll printer.

On the other hand, as shown in FIG. 7, inside the case 2, in addition to the paper holder 23 and together with the cutter mechanism 10, the head-supporting mechanism 11, and the link mechanism 36, these which are mentioned above, there is accommodated a mechanical mechanism 37 comprising a door-operating buffer mechanism 38 for the door 3, a movable-guide locking mechanism 39 for locking the movable guide 27 in the closed state, a grip-roller driving mechanism 40 for rotationally driving the grip roller 15, a pinch-roller moving mechanism 41 for moving the pinch roller 16 toward and from the grip roller 15, a winding-reel driving mechanism 42 and a feed-reel retaining mechanism 43 for winding the ink ribbon 19 while maintaining a constant tension, and a skewing-correction mechanism 45 (not shown) having first and second guide plates 44A and 44B arranged so as to sandwich the roll sheet 14 from both sides in the width direction, each being arranged at a predetermined position of a main chassis 47. Also, in the lower rear side inside the case 2, a control section 130 (FIG. 16) for controlling the entire operation of the color roll printer 1 is mounted.

The control section 130 controls various operations of the entire color roll printer 1 by controlling each mechanism of the mechanical mechanism 37 based on a predetermined control program.

In practice, as mentioned above referring to FIGS. 4 and 5, the control section 130 controls that after setting the tip of the sheet roll 14A to abut the internal door 22, when the door 3 is closed, the pinch roller 16 is pressed onto the grip roller 15 via the roll sheet 14 by firstly driving the pinch-roller moving mechanism 41 and then, the movable guide 27 is switched to the open state by driving the movable-guide locking mechanism 39 to release the locking of the movable guide 27 (FIG. 3).

In addition, the reason why that the movable guide 27 is switched to the open state after pressing the pinch roller 16 onto the grip roller 15 is to prevent a possibility that the tip end of the roll sheet 14 may hang down by its own weight within the space 35 between the paper holder 23 and the movable guide 27 in the open state, if the movable guide 27 is switched the open state before clamping the roll sheet 14 with the pinch roller 16 and the grip roller 15.

Figure 9:
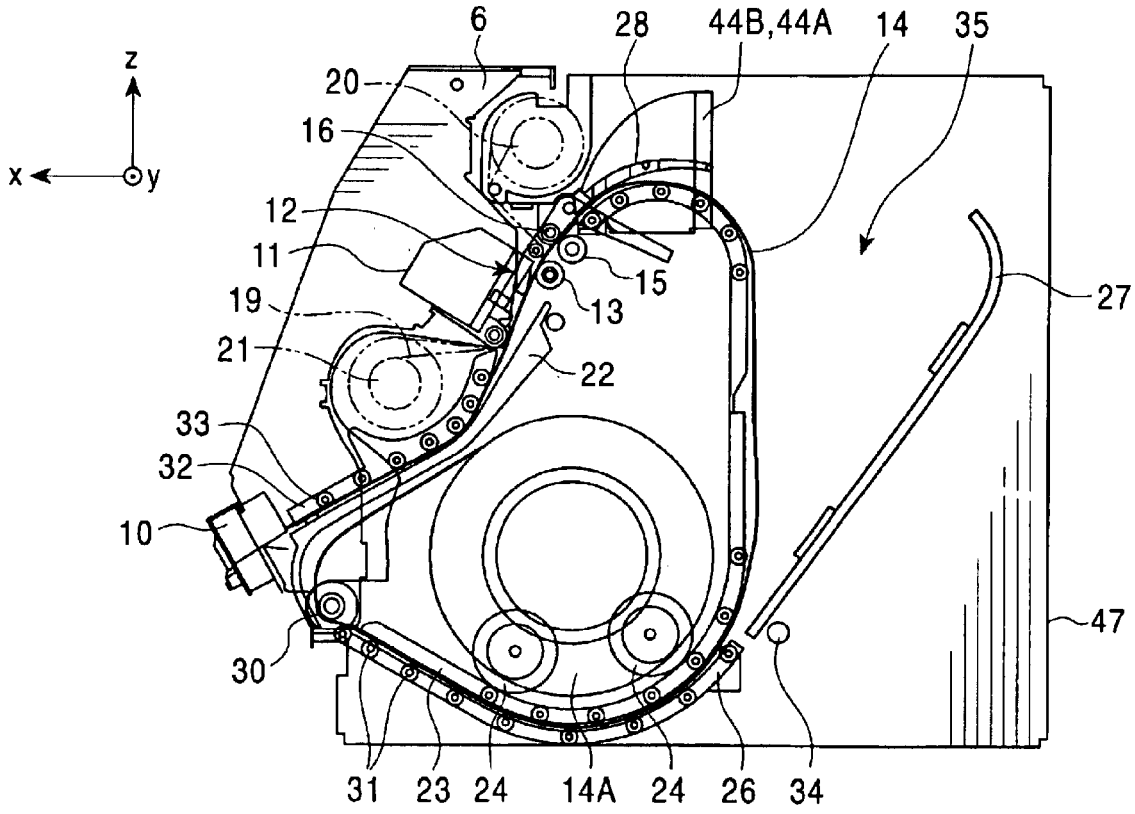
FIG. 9 is a schematic representation for showing an initial state during image printing.

Then, the control section 130 controls to discharge the tip end part of the roll sheet 14 by a predetermined length outside via the sheet-discharge opening 7A, as shown in FIG. 8, by driving the grip-roller driving mechanism 40 to run the roll sheet 14 in the discharging direction, and then, by driving the cutter mechanism 10, the roll sheet 14 discharged from the sheet-discharge opening 7A is cut off, as shown in FIG. 9.

In such a manner, the control section 130 discards the tip end part of the roll sheet 14, which may get stained when setting the roll sheet 14. In the color roll printer 1, the state immediately after the tip end part of the roll sheet 14 is cut off by the cutter mechanism 10 shown in FIG. 9 is the initial state of the printing operation.

On the other hand, thereafter, when a printing start button arranged on the operation panel 8 (FIG. 1) on the front face of the door 3 is pushed, the control section 130 moves the first and second guide plates 44A and 44B so as to sandwich the roll sheet 14 from the width direction by firstly driving the skewing-correction mechanism 45, while pressing the pinch roller 16 onto the grip roller 15 via the roll sheet 14 by driving the pinch-roller moving mechanism 41.

Figure 10:
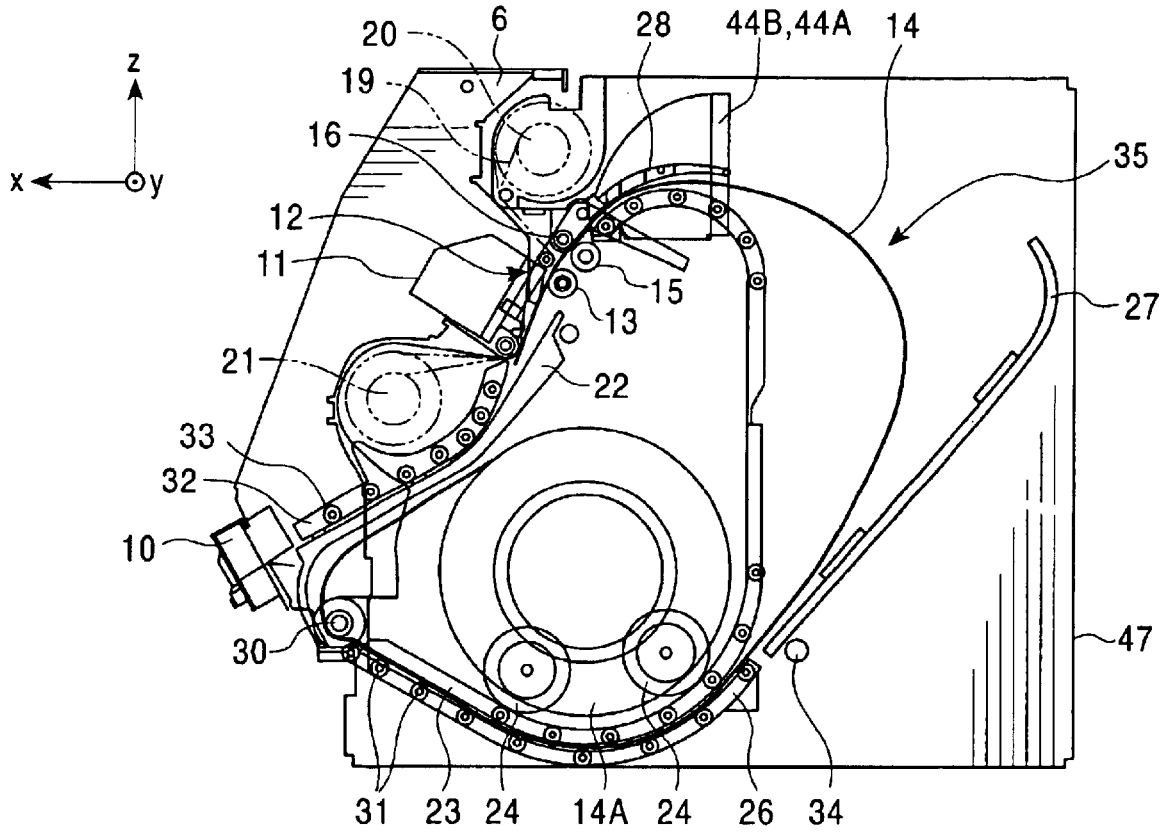
FIG. 10 is a schematic representation for showing a state of print-starting.

Then, the control section 130 pulls back the roll sheet 14 until the tip end thereof becomes the state of being fed from the printing position by a length corresponding to a picture size, as shown in FIG. 10, by driving the grip-roller driving mechanism 40, while winding the ink ribbon 19 onto the winding reel 20 so as to rewind the ink ribbon 19 by driving the winding-reel driving mechanism 42.

The control section 130 successively presses the thermal head 12 onto the platen 13 via the ink ribbon 19 and the roll sheet 14 in order by driving the head-supporting mechanism 11, and then, prints images based on supplied image data by one line one after another by the thermal head 12 while synchronizing the pulling back of the roll sheet 14 with the winding of the ink ribbon 19.

Upon completion of the hot printing process for one color in such a manner, the control section 130 separates the thermal head 12 from the platen 13 by driving the head-supporting mechanism 11, while the ink ribbon 19 is rewound for the next by driving the winding-reel driving mechanism 42.

Furthermore, after pulling back the roll sheet 14 to the printing position again by driving the grip-roller driving mechanism 40, the control section 130 presses the thermal head 12 onto the platen 13 via the ink ribbon 19 and the roll sheet 14 in order by driving the head-supporting mechanism 11 so as to operate hot printing processes for residual colors and lamination in the same manner as described above.

Figure 11:
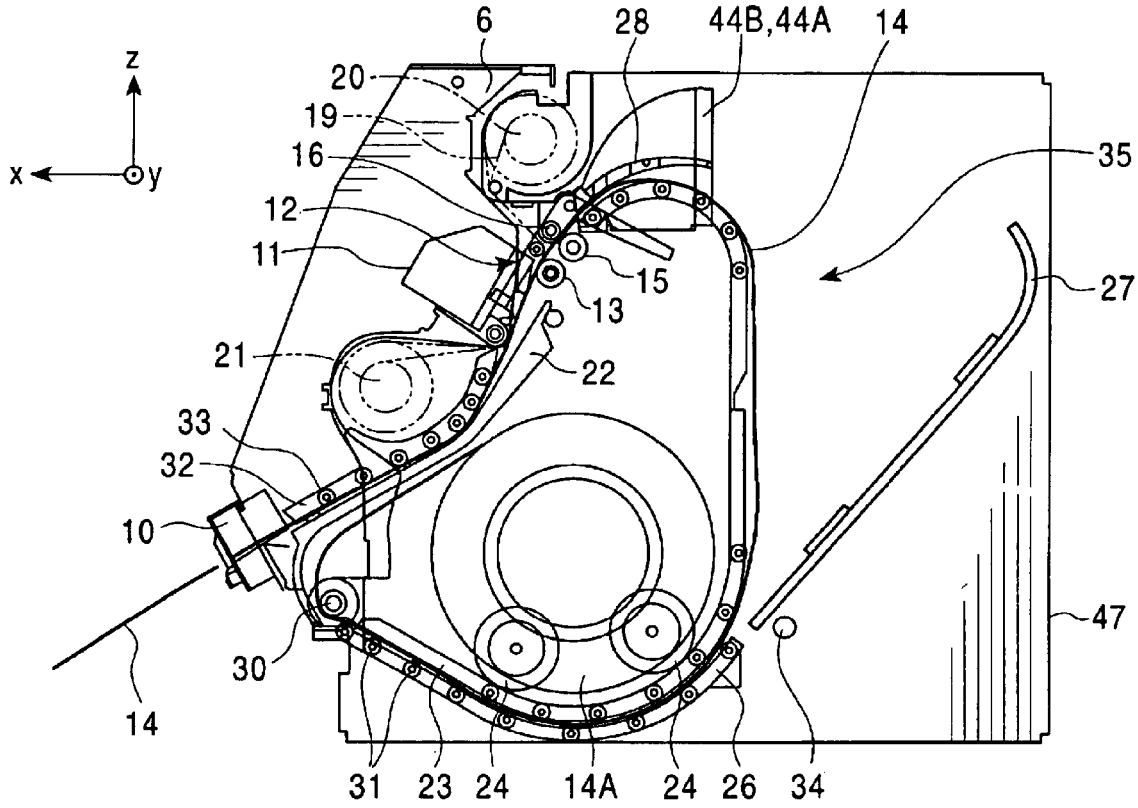
FIG. 11 is a schematic representation for showing a cutting operation.

Upon completion of the printing process of color images for one page in such a manner, the control section 130 feeds the roll sheet 14 by driving the grip-roller driving mechanism 40 after separating the thermal head 12 from the platen 13 by driving the head-supporting mechanism 11. Thereafter, the end part of the roll sheet 14 having images formed thereon is cut off by controlling the grip-roller driving mechanism 40 and the cutter mechanism 10 with predetermined timing, as shown in FIG. 11.

Then, the control section 130 repeats the processes described above until completion of sequential forming of the entire images on the roll sheet 14 based on the image data supplied thereafter.

In such a manner, the color roll printer 1 sequentially forms images on the roll sheet 14 based on the supplied image data.

(2) Detailed Structure of Ink Ribbon Driving System and Control Process for Ink Ribbon Driving by the Control Section 130

Next, the detailed structure of an ink ribbon driving system (the winding-reel driving mechanism 42 and the feed-reel retaining mechanism 43) and the control process for driving the ink ribbon by the control section 130 in the color roll printer 1 will be described below.

(2-1) The Structure of the Winding-Reel Driving Mechanism 42

Figure 12:
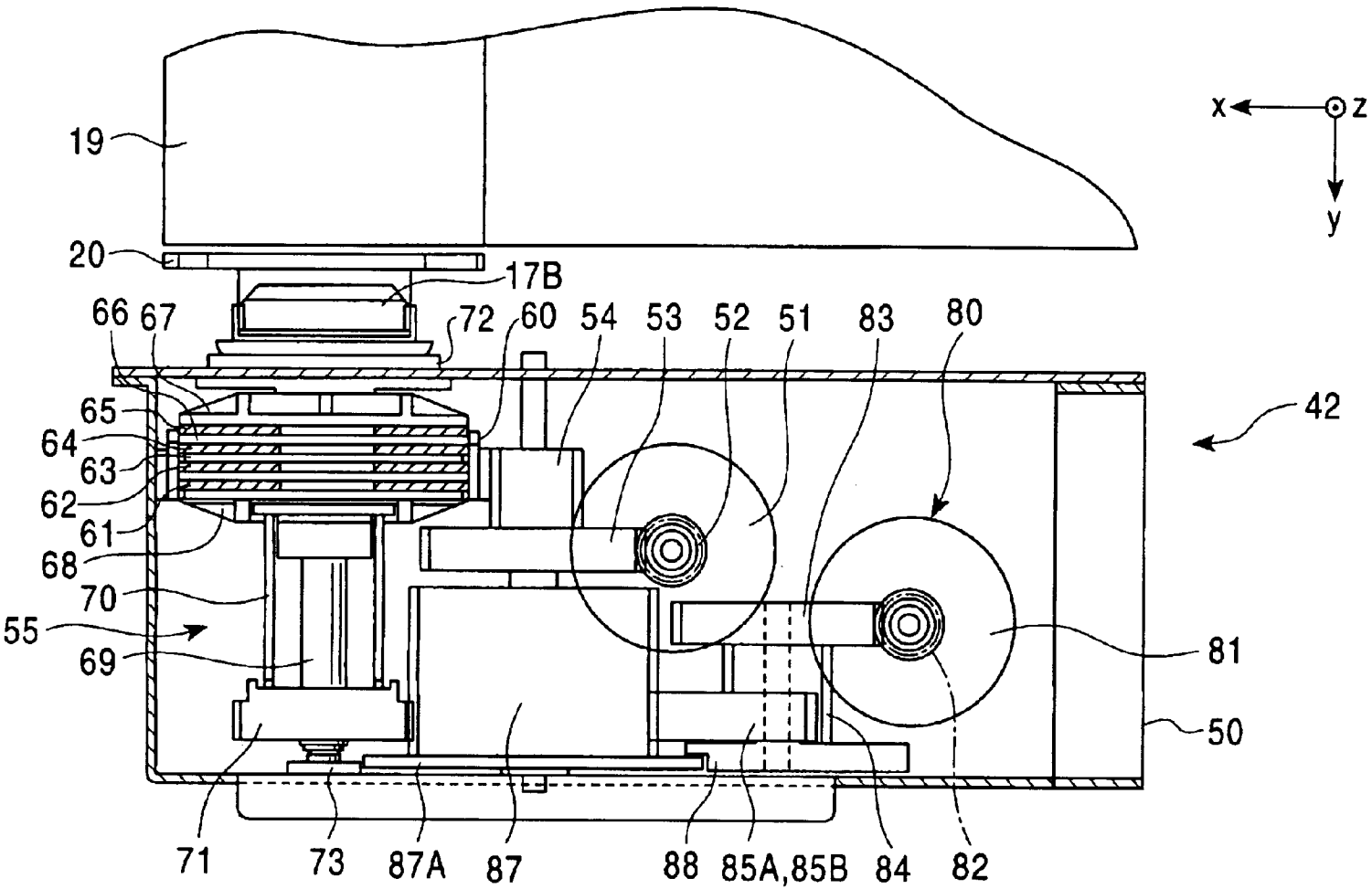
FIG. 12 is a schematic plan view showing the structure of a winding-reel driving section.
Figure 13:
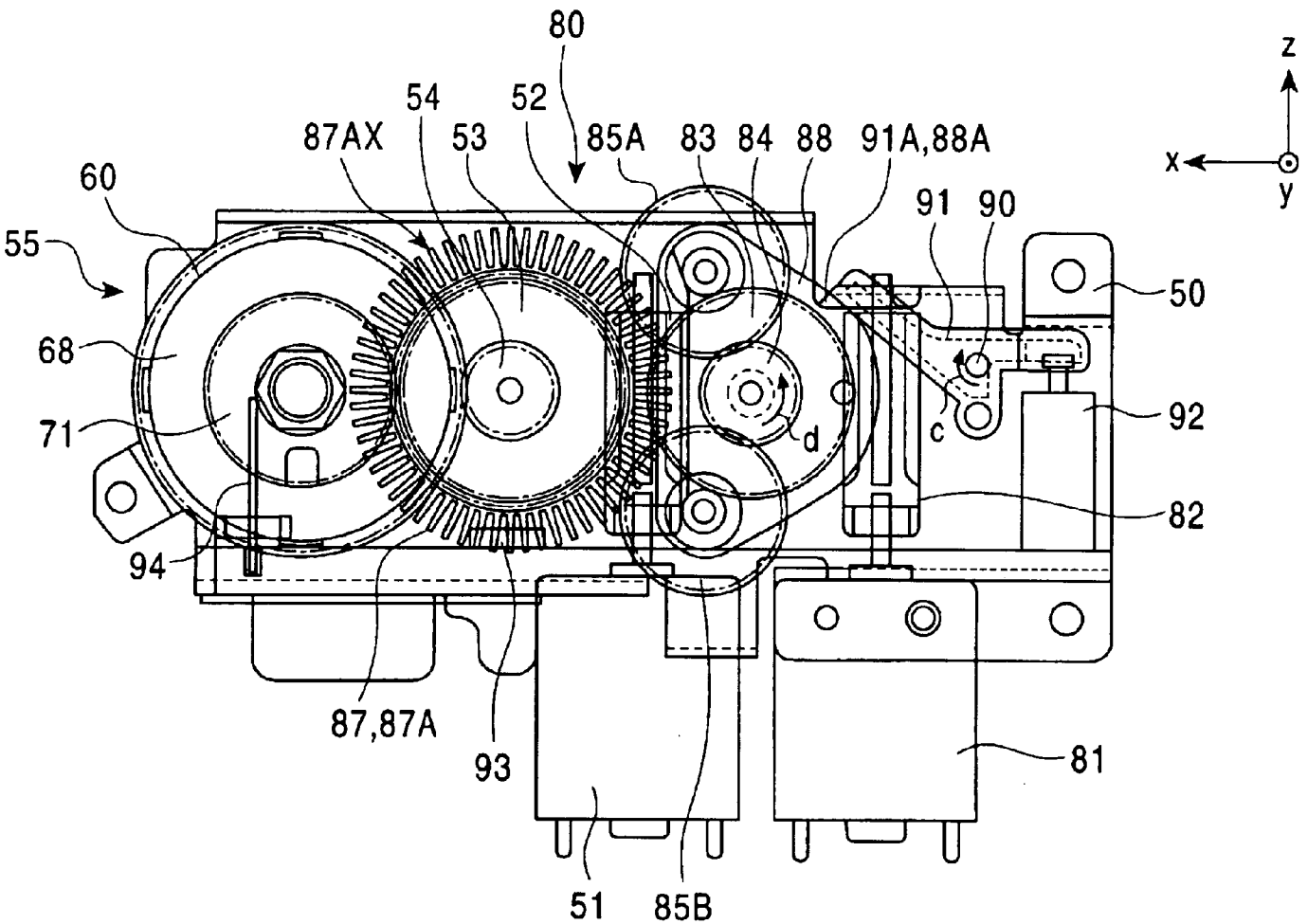
FIG. 13 is a schematic side view showing the structure of the winding-reel driving section.

As shown in FIGS. 12 and 13, the winding-reel driving mechanism 42 comprises a ribbon driving motor 51 fixed to a holder 50, and a worm gear 52 is attached to the output shaft of the ribbon driving motor 51 so as to mesh with a torque gear 60 of a torque limiter 55 via a gear 53 and a gear 54 formed integrally with the gear 53 in order.

The torque limiter 55 comprises the torque gear 60 having pieces of felt 61 and 62 bonded on both sides thereof, first and second sandwiching members 67 and 68 which sandwich the torque gear 60 therebetween by interposing a first insertion plate 63 and a second insertion plate 66 having pieces of felt 64 and 65 bonded on both sides thereof in one side of the torque gear 60, and a shaft 69 having a screw thread formed on the circumferential surface thereof, to which the first and second sandwiching members 67 and 68 are fitted to rotate integrally with the shaft 69, wherein the torque gear 60 and the first and second insertion plates 63 and 66 are fitted to one end of the shaft 69 so as to be rotatable relative to the shaft 69, and furthermore, the other end of the shaft 69 is screwed with a spring compression gear 71, and a compression coil spring 70 is interposed between the second sandwiching member 68 and the compression gear 71.

Also, in the torque limiter 55, the shaft 69 is pivotably and rotatably mounted on first and second bearings 72 and 73 attached to the holder 50, so that the entire structure is rotatable about the shaft 69. At one end of the shaft 69, the second winding-reel retainer 17B mentioned above is fixed.

In the winding-reel driving mechanism 42, the torque limiter 55 and the second winding-reel retainer 17B, which is integral with the torque limiter 55, can thereby be rotationally driven based on the rotational output of the ribbon driving motor 51 so as to rotate the winding reel 20 retained to the second winding-reel retainer 17B.

In the torque limiter 55 configured in such a manner, the rotational torque produced in the second winding-reel retainer 17B is determined by the pressure sandwiching the torque gear 60 with the first and second sandwiching members 67 and 68 therebetween (referred to as the sandwiching pressure below). The sandwiching pressure is determined by the urging force applied to the second sandwiching member 68 by the compression coil spring 70, and the urging force is determined by the spring length of the compression coil spring 70.

Therefore, in the torque limiter 55, by rotating the spring compression gear 71 so as to move the spring compression gear 71 along the shaft 69 in the arrow y direction or in the opposite to this direction, the rotational torque to be produced in the second winding-reel retainer 17B can be changed.

Therefore, in the winding-reel driving mechanism 42, a spring-compression-gear rotational driving system 80 is arranged as rotating means for moving the spring compression gear 71 along the shaft 69 in the arrow y direction or in the opposite to this direction by engaging with the spring compression gear 71 only when adjusting the torque to be produced in the second winding-reel retainer 17B, and the rotating means does not interfere the rotation of the spring compression gear 71 which rotates integrally with the shaft 69 when the winding reel 20 is rotationally driven.

In practice, the spring-compression-gear rotational driving system 80 comprises a torque adjusting motor 81 fixed to the holder 50, a worm gear 82 attached to the output shaft of the torque adjusting motor 81, first and second pendulum gears 85A and 85B which are meshed with the worm gear 82 via a gear 83 and a gear 84 in order, and an encoder gear 87 which is meshed with the spring compression gear 71 and has substantially the same thickness as the movable range of the spring compression gear 71 in the shaft 69.

In the situation, the first and second pendulum gears 85A and 85B are rotatably mounted on a pendulum plate 88 arranged rotatably about the same rotational shaft as that for the gears 83 and 84. The pendulum plate 88 is also restricted in rotation under normal conditions by the fitting between a notch 88A formed at a predetermined position of the pendulum plate 88 and a claw 91A at one end of a lock arm 91 arranged rotatably about a shaft 90 as shown in FIG. 13, thereby enabling the first and second pendulum gears 85A and 85B not to be meshed with the encoder gear 87.

Furthermore, in the other end side of the lock arm 91, the output shaft of a plunger 92 fixed to the holder 50 is fixed so as to release the rotational restriction of the pendulum plate 88 by driving the plunger 92 so as to rotate the lock arm 91 in the arrow c direction.

In the released state of the rotational restriction of the pendulum plate 88 in such a manner, when the torque adjusting motor 81 is driven in the normal direction, the gear 84 rotates in the arrow d direction and the first and second pendulum gears 85A and 85B rotate integrally therewith while the pendulum plate 88 is rotated in the arrow d direction by the rotational momentum of the gear 84 so that the first pendulum gear 85A is meshed with the encoder gear 87 so as to apply a rotational force for proceeding in the opposite to the arrow y direction to the spring compression gear 71 via the encoder gear 87.

On the other hand, in the released state of the rotational restriction of the pendulum plate 88, when the torque adjusting motor 81 is driven in the reverse direction, the gear 84 rotates in the opposite to the arrow d direction and the first and second pendulum gears 85A and 85B rotate integrally therewith while the pendulum plate 88 is rotated in the opposite to the arrow d direction by the rotational momentum of the gear 84 so that the second pendulum gear 85B is meshed with the encoder gear 87 so as to apply a rotational force for proceeding in the arrow y direction to the spring compression gear 71 via the encoder gear 87.

By this structure in the winding-reel driving mechanism 42, in the restricted sate in rotation of the torque gear 60 by stopping driving the ribbon driving motor 51, driving the torque adjusting motor 81 in the normal direction while driving the plunger 92 increases the rotational torque to be produced in the second winding-reel retainer 17B. On the other hand, under the same conditions, driving the torque adjusting motor 81 in the reverse direction decreases the rotational torque to be produced in the second winding-reel retainer 17B.

In addition, in the winding-reel driving mechanism 42, since the lock arm 91 is urged in the opposite to the arrow c direction by a torsion spring (not shown), after adjusting the rotational torque produced in the second winding-reel retainer 17B by driving the torque adjusting motor 81, when the torque adjusting motor 81 is driven next in the direction opposite to this, the first and second pendulum gears 85A and 85B can be held not to be meshed with the encoder gear 87 by the pendulum plate 88.

Also, in the winding-reel driving mechanism 42, in one end part of the circumferential surface of the encoder gear 87 in the thickness direction, a thin encoder part 87A having slits 87AX formed at predetermined intervals along the whole circumference is mounted while an interrupter-type rotation detecting sensor 93 (FIG. 13) is attached to the holder 50 at a position corresponding to that of the encoder part 87A. In the holder 50, a position detecting sensor 94 (FIG. 13) for detecting the spring compression gear 71 positioned at a home position arranged at the end of the shaft 69 in the arrow y direction is disposed.

By this structure in the winding-reel driving mechanism 42, the position of the spring compression gear 71 in the shaft 69 can be detected on the basis of outputs of the rotation detecting sensor 93 and the position detecting sensor 94.

(2-2) Structure of the Feed-Reel Retaining Mechanism 43

Figure 14:
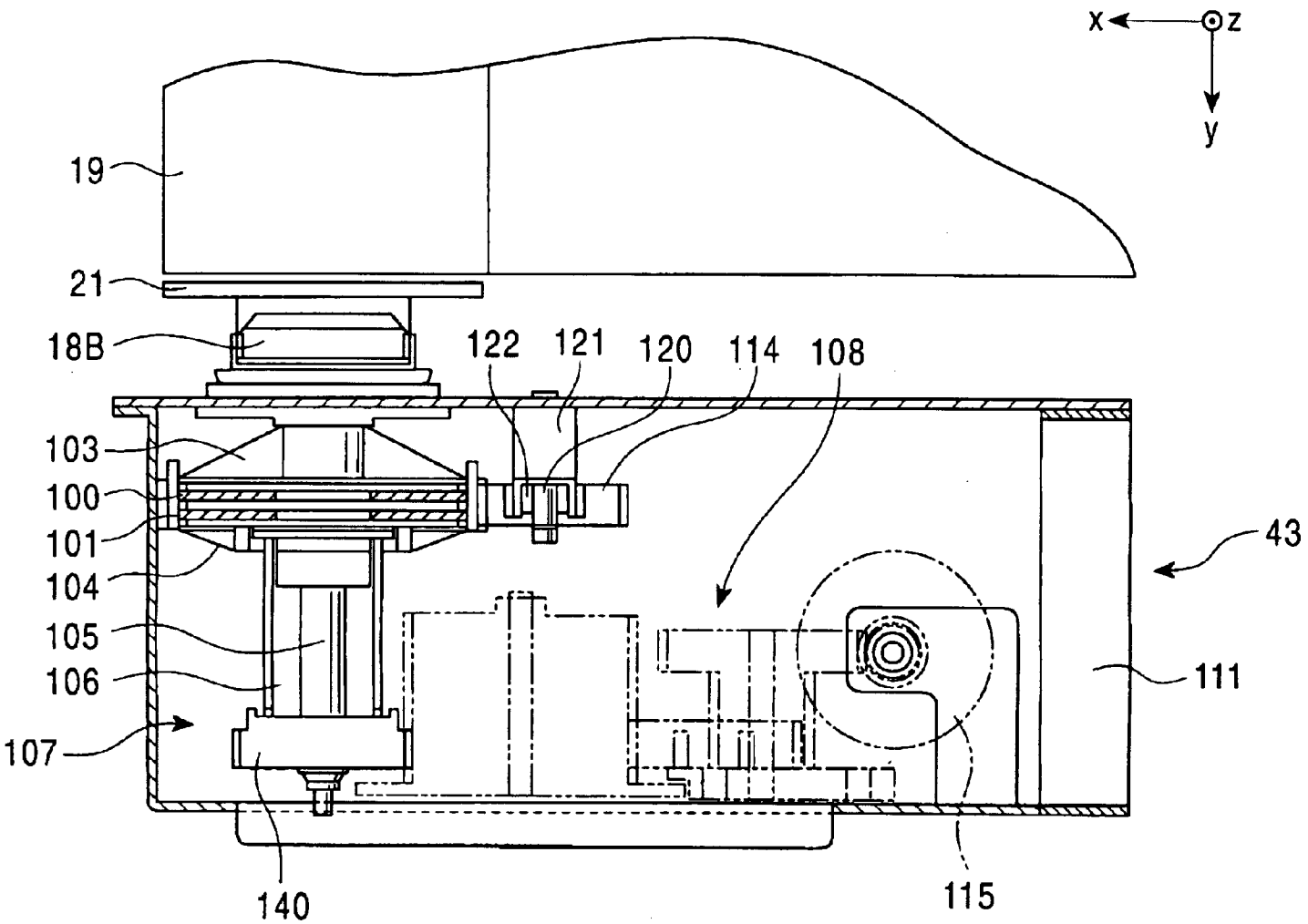
FIG. 14 is a schematic plan view showing the structure of a feed-reel driving section.
Figure 15:
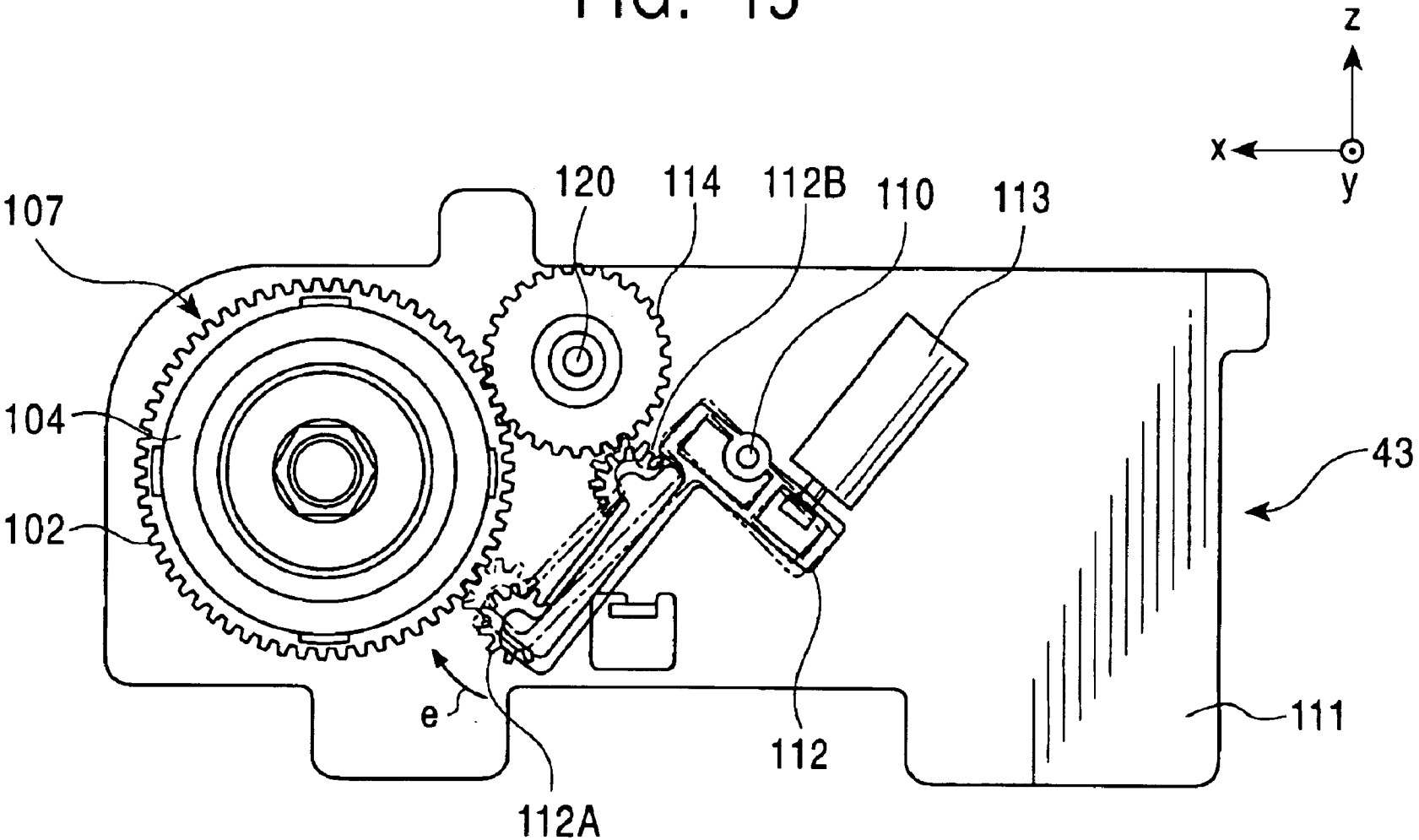
FIG. 15 is a schematic side view showing the structure of the feed-reel driving section.

On the other hand, as shown in FIGS. 14 and 15, the feed-reel retaining mechanism 43 comprises a torque limiter 107 configured in the same structure as that of the torque limiter 55 (FIGS. 11 and 12) of the winding-reel driving mechanism 42 (FIGS. 11 and 12) except that a torque gear 102 having pieces of felt 100 and 101 bonded on both sides thereof is directly sandwiched between first and second sandwiching members 103 and 104, and a spring-compression-gear rotational driving system 108 configured in the same structure as that of the spring-compression-gear rotational driving system 80 (FIGS. 11 and 12) of the winding-reel driving mechanism 42. At one end of a shaft 105 of the torque limiter 107, the second feed-reel retainer 18B mentioned above is fixed.

The feed-reel retaining mechanism 43, as shown in FIG. 15, is provided with a lock arm 112 attached to a holder 111 rotatably about a shaft 110, a plunger 113 having an output shaft attached to one end of the lock arm 112, and an idler gear 114 attached so as to meshed the torque gear 102 of the torque limiter 107.

In this lock arm 112, there are provided first and second gears 112A and 112B corresponding to the torque gear 102 and the idler gear 114, respectively, while the lock arm 112 is urged in the arrow e direction by a torsion spring (not shown).

By this structure, in the feed-reel retaining mechanism 43, under normal conditions, the first and second gears 112A and 112B of the lock arm 112 are respectively meshed with the torque gear 102 and the idler gear 114 so as to lock the torque gear 102 so that it does not rotate and a first load torque set up by the spring-compression-gear rotational driving system 108 (FIG. 14) can be produced in the second feed-reel retainer 18B. Furthermore, in this state, by driving a torque adjusting motor 115 in the spring-compression-gear rotational driving system 108, the load torque to be produced in the second feed-reel retainer 18B can be changed.

Also, the idler gear 114 is rotatably attached to the end part of a shaft 120 mounted to the holder 111 in parallel to the arrow y direction, and has a predetermined rotational load due to the urging force in the arrow y direction applied by a compression coil spring 122 arranged between a spring receiver 121 fitted to the shaft 120 and the idler gear 114.

By this structure of the feed-reel retaining mechanism 43, when the locking of the torque gear 102 by the lock arm 112 is released by driving the plunger 113 on demand, a second load torque can be produced in the second feed-reel retainer 18B, which is smaller than the first load torque and corresponding to the urging force applied to the idler gear 114 by the compression coil spring 122.

In such a manner, in the feed-reel retaining mechanism 43, the load torque to be produced in the second feed-reel retainer 18B can be switched according to two-stage.

(2-3) Control Process by the Control Section 130 for Ink-Ribbon Driving

Figure 16:
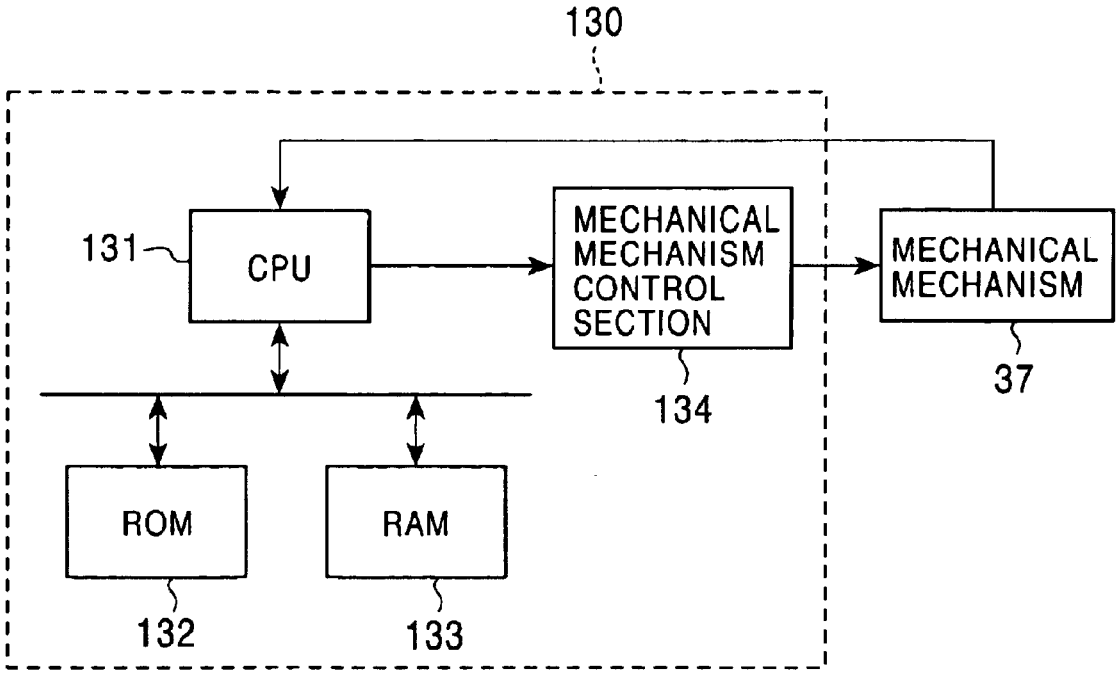
FIG. 16 is a simplified block diagram of the structure of a control section.

The control section 130, as shown in FIG. 16, comprises a CPU (Central Processing Unit) 131, an ROM (Read Only Memory) 132, and an RAM (Random Access Memory) 133, and the CPU 131 controls and drives corresponding actuators such as motors and plungers in the mechanical mechanism 37 via a mechanical mechanism control section 134 on the basis of various control programs stored in the ROM 132 and various sensor outputs fed from various sensors in the mechanical mechanism 37, so that various operations described above can be performed.

In practice, during image printing, for example, the CPU 131 feeds the ink ribbon 19 by one line one after another, while synchronizing with the roll sheet 14, by driving the ribbon driving motor 51 in the winding-reel driving mechanism 42, as described above, and also it rewinds the ink ribbon 19.

The CPU 131, during the rewinding the ink ribbon 19, reduces the load torque of the feed reel 21 enabling high-speed winding of the ink ribbon 19 by driving the plunger 113 in the feed-reel retaining mechanism 43 so as to switch the load torque to be produced in the second feed-reel retainer 18B to the second load torque smaller than the first load torque during the image printing.

In addition to such control processes, the CPU 131, during the image printing, estimates the diameter of the roll of ink ribbon 19 wound onto the winding reel 20 and the diameter of the roll of ink ribbon 19 wound onto the feed reel 21, and it drives the torque adjusting motor 81 of the winding-reel driving mechanism 42 and the torque adjusting motor 115 of the feed-reel retaining mechanism 43 so as to maintain the tension of the ink ribbon 19 at all times based on estimated results.

That is, during the image printing, first and second FG (Frequency Generator) pulses, which rise every rotation at a predetermined angle of the torque limiters 55 and 107, are applied to the CPU 131 from a rotation detecting sensor (not shown) for detecting the rotation of the torque limiter 55 disposed in the winding-reel driving mechanism 42 and a rotation detecting sensor (not shown) for detecting the rotation of the torque limiter 107 disposed in the feed-reel retaining mechanism 43.

Then, the CPU 131 firstly computes the diameter of the roll of ink ribbon 19 wound onto the winding reel 20 and the diameter of the roll of ink ribbon 19 wound onto the feed reel 21 on the basis of the first and second FG pulses.

In practice, when the length of the ink ribbon 19 for one color is L; the number of the FG pulses obtained at this time is FG; the roll diameter of the ink ribbon 19 wound onto the winding reel 20 or the feed reel 21 at this time is R; the tension of the ink ribbon 19 at this time is F; and the number of the FG pulses for one round of the winding reel 20 or the feed reel 21 is FG1, the following equation holds:

[Numerical Formula 1]

$$L=(FG/92.6316)*2\pi R \tag{1}$$

Thereby, the computation can be performed by the following equation:

[Numerical Formula 2]

$$R=(1/2\pi)\cdot(FG1/FG)\cdot L \tag{2}$$

Then, in order to maintain a constant tension of the ink ribbon 19, the CPU 131 computes the number of revolutions of the spring compression gear 71 of the torque limiter 55 in the winding-reel driving mechanism 42 or a spring compression gear 140 of the torque limiter 107 in the feed-reel retaining mechanism 43, that is, the CPU 131 computes how much drive the torque adjusting motors 81 and 115 until how many numbers of FG pulses are applied from the above-mentioned rotation detecting sensor 93 (FIG. 13) in the winding-reel driving mechanism 42 or the feed-reel retaining mechanism 43.

In practice, when the rotational torque or load torque of the second winding-reel retainer 17B or the second feed-reel retainer 18B is T, the following equation holds:

[Numerical Formula 3]

$$\begin{aligned} F &= T/R \\ &= T/((1/2\pi)\cdot(FG1/FG)\cdot L) \\ &= (2\pi/FG1)\times(FG\times T/L) \end{aligned} \tag{3}$$

Thereby, in order to maintain the constant tension F of the ink ribbon 19, the rotational torque or load torque T of the second winding-reel retainer 17B or the second feed-reel retainer 18B may be produced so as to satisfy the following equation:

[Numerical Formula 4]

$$T=(FG1/2\pi)\cdot(F\times L/FG) \tag{4}$$

Also, the relationship between the rotational torque or load torque T of the second winding-reel retainer 17B or the second feed-reel retainer 18B and the number of the FG pulses applied from the rotation detecting sensor 93 (FIG. 13) in the winding-reel driving mechanism 42 or the feed-reel retaining mechanism 43 can be detected by measurements in advance. For example, according to the embodiment, when the number of FG pulses is tFG, the relationship in the winding side is obtained from the following equation:

[Numerical Formula 5]

$$T=tFG\times 1.55+500\ (gf\cdot cm)\ \text{(Experimental Result)}\ \therefore tFG=(T-500)/1.55 \tag{5}$$

Also, the relationship in the feed side is obtained from the following equation:

[Numerical Formula 6]

$$T=tFG\times 0.24+150\ (gf\cdot cm)\ \therefore tFG=(T-150)/0.24\ \text{(Experimental Result)} \quad (6)$$

By performing these computations, the CPU 131 computes each of tFGs in the winding and feed sides. On the basis of computed results, every time when the printing for one color or one picture, for example, is finished, the plunger 92 (FIG. 13) in the winding-reel driving mechanism 42 or the feed-reel retaining mechanism 43 is driven in a state that the ribbon driving motor 51 in the winding-reel driving mechanism 42 is stopped driving while the torque adjusting motors 81 and 115 (FIGS. 12 and 14) in the winding-reel driving mechanism 42 or the feed-reel retaining mechanism 43 are driven. In such a manner, the CPU 131 maintains the tension of the ink ribbon 19 at all times.

In addition, upon switching-on, the CPU 131 performs control by setting temporary rotational torque and load torque from the residual sheets of the ink ribbon 19, and then, it controls so as to maintain the tension of the ink ribbon 19 at all times by the same processing based on the FG pulses obtained by the printing operation thereafter from the rotation detecting sensor in the winding-reel driving mechanism 42 and the rotation detecting sensor in the feed-reel driving mechanism 43.

(3) Operations and Advantages of the Embodiment

In the structure described above, the CPU 131 estimates the diameter of the roll of ink ribbon 19 wound onto the winding reel 20 and the diameter of the roll of ink ribbon 19 wound onto the feed reel 21, and based on the estimated results, it controls the winding-reel driving mechanism 42 and the feed-reel retaining mechanism 43 so as to maintain the tension of the ink ribbon 19 at all times.

Therefore, in the color roll printer 1, the tension of the ink ribbon 19 can be maintained constant at all times regardless of the diameter of the roll of ink ribbon 19 wound onto the winding reel 20 and the diameter of the roll of ink ribbon 19 wound onto the feed reel 21.

Also, in the color roll printer 1, the torque limiters 55 and 107 in the winding-reel driving mechanism 42 and the feed-reel retaining mechanism 43 are configured as shown in FIGS. 12 to 15, so that the torque limiter capable of torque-adjusting at will can be inexpensively constructed in a simple and light-weight structure, resulting in advances in the simplification and reduction in weight and cost of the entire color roll printer 1.

By the structure described above, the diameter of the roll of ink ribbon 19 wound onto the winding reel 20 and the diameter of the roll of ink ribbon 19 wound onto the feed reel 21 are estimated, and based on the estimated results, the winding-reel driving mechanism 42 and the feed-reel retaining mechanism 43 are controlled so as to maintain the tension of the ink ribbon 19 constant. Thereby, the tension of the ink ribbon 19 can be maintained constant at all times, resulting in achievement of a color roll printer capable of constant tension-controlling in a simple structure.

(4) Other Embodiments

In addition, in the embodiment described above, the present invention is described by applying it to the color roll printer 1 shown in FIG. 1; however, the present invention is not limited to this, and it can be applied to other printer apparatuses with various structures.

In the embodiment described above, as the first torque generating means for variably generating the load torque to the feed reel 21 of the ink ribbon 19, the feed-reel driving mechanism 43 configured as shown in FIGS. 14 and 15 is described; however, the present invention is not limited to this and other various structures may be widely applied.

Furthermore, in the embodiment described above, as the second torque generating means for variably generating the load torque to the winding reel 20 of the ink ribbon 19, the winding-reel driving mechanism 42 configured as shown in FIGS. 12 and 13 is described; however, the present invention is not limited to this and other various structures may be widely applied.

Furthermore, in the embodiment described above, as the controlling means for controlling the winding-reel driving mechanism 42 and the feed-reel retaining mechanism 43 so as to produce the load torque or rotational torque corresponding to the roll diameter of the ink ribbon 19 wound onto the feed reel 21 and/or the winding reel 20, the control section 130 configured as shown in FIG. 16 is described; however, the present invention is not limited to this and other various structures may be widely applied.

What is claimed is:

1. A printer apparatus for printing images by pressing a head on a printing sheet via an ink ribbon carried by a feed reel and a winding reel, the printer apparatus comprising:

first torque-generating means for generating a variable load torque applied to the feed reel, which is rotatably supported: second torque-generating means for variably generating a rotational torque to the winding reel, which is rotatably supported; and controlling means for controlling the first and/or second torque-generating means so as to generate one of the load torque and rotational torque in accordance with the diameter of the roll of ink ribbon wound on the feed reel and/or the winding reel;

wherein the first torque-generating means comprises:

a shaft which is rotatably pivotably mounted and which has a screw thread formed on the circumferential surface thereof;

a first gear rotatably fitted to the shaft;

first and second sandwiching members fitted to the shaft so as to sandwich the first gear therebetween and to rotate integrally with the shaft;

a second gear rotatably screwed on the shaft; and a spring arranged between the second gear and one of the first and second sandwiching members opposing the second gear; and driving means for rotationally driving the second gear relative to the shaft, and wherein the controlling means generates the load torque in the first torque-generating means in accordance with the diameter of the roll of ink ribbon wound on the feed reel and/or the winding reel so as to control the position of the second gear in the shaft via the driving means.

2. A printer apparatus according to claim 1 further comprising:

a third gear having a predetermined rotational load and being rotatably arranged so as to mesh the second gear; and fixing means for fixing the first gear so that it does not rotate, the fixing means being switchable between the fixing and releasing the first gear, and wherein the controlling means switches the load torque to be generated in the feed reel so as to drive the fixing means according to demand.

3. Apparatus for printing images by pressing a head on a printing sheet via an ink ribbon carried by a feed reel and a winding reel, the printer apparatus comprising:

first torque-generating means for generating a variable load torque applied to the feed reel, which is rotatably supported;

second torque-generating means for variably generating a rotational torque to the winding reel, which is rotatably supported; and controlling means for controlling the first and/or second torque-generating means so as to generate one of the load torque and rotational torque in accordance with the diameter of the roll of ink ribbon wound on the feed reel and/or the winding reel;

wherein the second torque-generating means comprises:

a shaft which is rotatably pivotably mounted and which has a screw thread formed on the circumferential surface thereof;

a first gear rotatably fitted to the shaft;

first and second sandwiching members fitted to the shaft so as to sandwich the first gear therebetween and to rotate integrally with the shaft;

a second gear rotatably screwed on the shaft;

a spring arranged between the second gear and one of the first and second sandwiching members opposing the second gear;

first driving means for rotationally driving the first gear; and second driving means for rotationally driving the second gear relative to the shaft, and wherein the controlling means generates the rotational torque in'the second torque generating means in accordance with the diameter of the roll of ink ribbon wound on the feed reel and/or the winding reel so as to control the position of the second gear in the shaft via the second driving means.

4. A printer apparatus according to claim 3, further comprising:

a third gear having a predetermined rotational load and being rotatably arranged so as to mesh the second gear; and fixing means for fixing the first gear so that it does not rotate, the fixing means being switchable between the fixing and releasing the first gear, and wherein the controlling means switches the load torque to be generated in the feed reel so as to drive the fixing means according to demand.

* * * * *